US011443880B2

(12) United States Patent
Inaba

(10) Patent No.: US 11,443,880 B2
(45) Date of Patent: Sep. 13, 2022

(54) REACTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Kazuhiro Inaba, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 350 days.

(21) Appl. No.: 16/762,680

(22) PCT Filed: Nov. 6, 2018

(86) PCT No.: PCT/JP2018/041170
§ 371 (c)(1),
(2) Date: May 8, 2020

(87) PCT Pub. No.: WO2019/102840
PCT Pub. Date: May 31, 2019

(65) Prior Publication Data

US 2021/0174999 A1 Jun. 10, 2021

(30) Foreign Application Priority Data

Nov. 21, 2017 (JP) ..... JP2017-223945

(51) Int. Cl.
*H01F 17/04* (2006.01)
*H01F 3/14* (2006.01)
(Continued)

(52) U.S. Cl.
CPC ..... *H01F 17/045* (2013.01); *H01F 3/14* (2013.01); *H01F 27/2823* (2013.01); *H01F 27/324* (2013.01); *H01F 2017/048* (2013.01)

(58) Field of Classification Search
CPC ..... H01F 17/045; H01F 3/14; H01F 27/2823; H01F 27/324; H01F 2017/048; H01F 27/022; H01F 27/263; H01F 37/00
See application file for complete search history.

(56) References Cited

U.S. PATENT DOCUMENTS

2013/0107580 A1* 5/2013 Inaba ..... H01F 27/306 363/16
2013/0114319 A1* 5/2013 Inaba ..... H01F 27/025 363/131
(Continued)

FOREIGN PATENT DOCUMENTS

JP 2007-013042 A 1/2007
JP 2011-253982 A 12/2011
(Continued)

OTHER PUBLICATIONS

Dec. 11, 2018 International Search Report issued in International Patent Application No. PCT/JP2018/041170.

*Primary Examiner* — Jared Fureman
*Assistant Examiner* — Michael J Warmflash
(74) *Attorney, Agent, or Firm* — Oliff PLC

(57) ABSTRACT

A reactor including: a coil having a wound portion; a magnetic core that includes an inner core disposed in the wound portion, the magnetic core forming a closed magnetic circuit; and a resin mold including an inner resin that is interposed between the wound portion and the inner core, and at least partially covers the inner core, the resin mold not covering an outer-peripheral face of the wound portion.

5 Claims, 3 Drawing Sheets

(51) Int. Cl.
*H01F 27/28* (2006.01)
*H01F 27/32* (2006.01)

(56) References Cited

U.S. PATENT DOCUMENTS

| | | | | |
|---|---|---|---|---|
| 2014/0050001 | A1* | 2/2014 | Inaba | H01F 37/00 336/221 |
| 2018/0211758 | A1* | 7/2018 | Shitama | H01F 27/2823 |
| 2019/0259532 | A1* | 8/2019 | Hirabayashi | H01F 27/2823 |

FOREIGN PATENT DOCUMENTS

| | | | | |
|---|---|---|---|---|
| JP | 2011253982 | A | * | 12/2011 |
| JP | 2013-012643 | A | | 1/2013 |
| JP | 2016-171192 | A | | 9/2016 |
| JP | 2017-028142 | A | | 2/2017 |
| JP | 2017-135334 | A | | 8/2017 |
| JP | 2017-175083 | A | | 9/2017 |

* cited by examiner

REACTOR

BACKGROUND

The present disclosure relates to a reactor.

The present application claims priority of Japanese Application No. 2017-223945 filed Nov. 21, 2017, the entire contents of which is incorporated herein by reference.

JP 2017-135334A discloses, as a reactor for use in a vehicle converter or the like, a reactor that includes a coil, a magnetic core, and a resin mold portion. The coil includes two wound portions. The magnetic core includes a plurality of core pieces that are disposed on the inner and outer sides of the wound portions and are fitted to form a ring shape. The resin mold portion covers the outer periphery of the magnetic core, and exposes the coil rather than covering it.

SUMMARY

A reactor according to the present disclosure includes: a coil having a wound portion; a magnetic core that includes an inner core disposed in the wound portion, the magnetic core forming a closed magnetic circuit; and a resin mold including an inner resin that is interposed between the wound portion and the inner core, and at least partially covers the inner core, the resin mold not covering an outer-peripheral face of the wound portion; the inner core including: a basic region having a predetermined magnetic-path cross-sectional area; and a single middle region having a magnetic-path cross-sectional area smaller than the magnetic-path cross-sectional area of the basic region, the middle region being disposed in a region near a middle portion of the wound portion in an axial direction thereof, the region including the middle portion, the middle region being provided in one core piece, and the inner resin is formed by charging a constituent resin into a ring-shaped groove formed by a step between the basic region and the middle region, and includes a thick portion with a thickness larger than a thickness of an area covering the basic region.

DETAILED DESCRIPTION OF EMBODIMENTS

Figure 1:
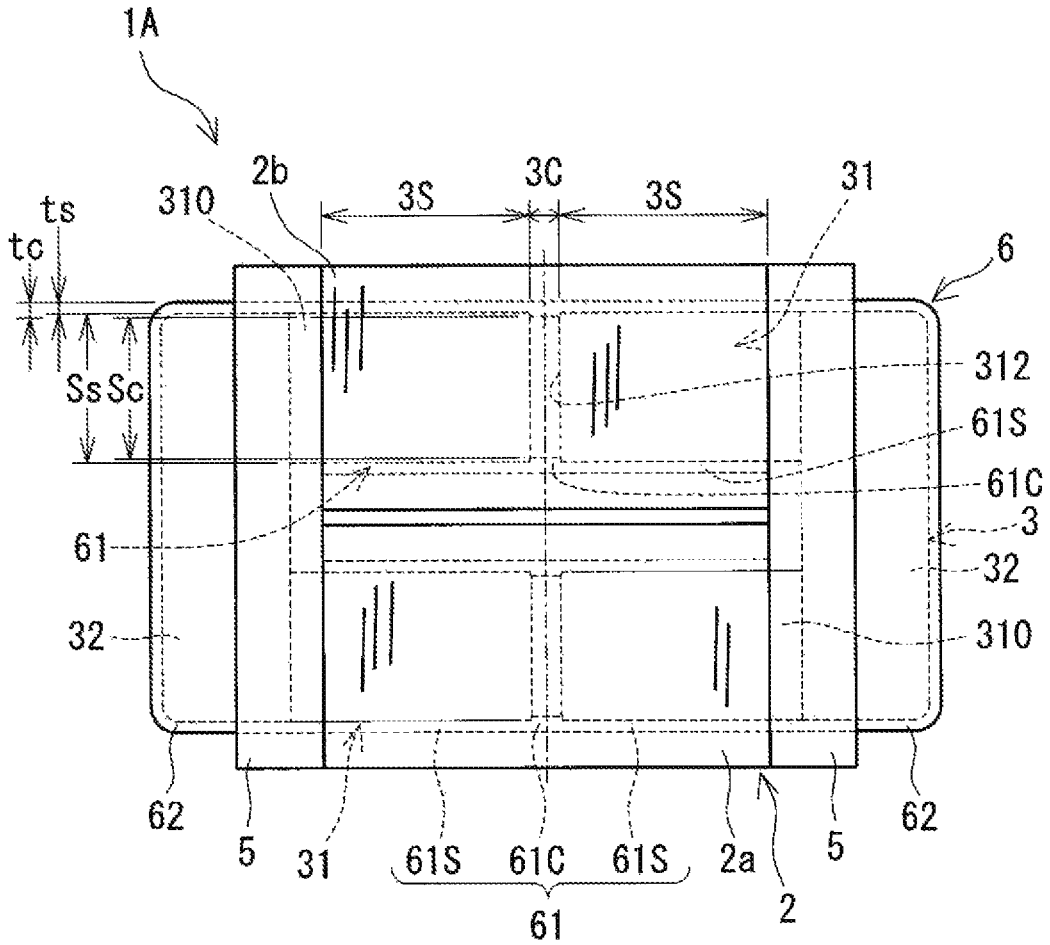
FIG. 1 is a schematic top view of a reactor according to Embodiment 1.

It is desired that the strength of reactors be increased.

As mentioned above, a plurality of core pieces can be maintained in a state of being fitted to form a ring shape by covering the core pieces with a resin mold portion. However, the mechanical strength of resin is lower than that of the core pieces that are constituted by molded bodies that contain a soft magnetic material such as iron. Thus, for example, if thermal stress, external vibration, or the like is applied to the reactor, stress is likely to be concentrated on the middle portion of each wound portion in the axial direction and a region therearound, and cracking may occur in a portion of the resin mold portion that covers the core pieces disposed near the aforementioned middle portion. Accordingly, there is a demand for a higher-strength reactor with a resin mold portion that is unlikely to crack.

In the case of forming the resin mold portion by means of injection molding as described in JP 2017-135334A, it is conceivable, as an example, that a fluid-state resin (which may also be hereinafter referred to as a molding material), which serves as a material of the resin mold portion, is charged from two end sides of the wound portions in the axial direction (which may also be hereinafter referred to as bidirectional charging). Bidirectional charging shortens the charging time, and excellent manufacturability of the reactor is achieved. In this case, however, the last charging position of the molding material is the middle portion of each wound portion in the axial direction and a region therearound, and a merging area, i.e. an area in which the molding material merges is likely to be disposed at the middle portion of each wound portion in the axial direction and the region therearound. The aforementioned merging area includes a weld line or the like, and has a lower mechanical strength than that of areas other than the merging area. For this reason, if bidirectional charging is carried out, cracking is likely to occur in the area near the aforementioned middle portion in the resin mold portion. Thus, the area near the aforementioned middle portion in the resin mold portion can be considered as a weak point in terms of mechanical strength.

An exemplary aspect of the disclosure provides a higher-strength reactor.

The above-described reactor has excellent strength.

DESCRIPTION OF EMBODIMENTS OF PRESENT DISCLOSURE

First, embodiments of the present disclosure will be listed and described.

(1) A reactor according to an embodiment of the present disclosure includes:

a coil having a wound portion;

a magnetic core that includes an inner core portion disposed in the wound portion, the magnetic core forming a closed magnetic circuit; and a resin mold portion including an inner resin portion that is interposed between the wound portion and the inner core portion, and at least partially covers the inner core portion, the resin mold portion not covering an outer-peripheral face of the wound portion;

the inner core portion including:

- a basic region having a predetermined magnetic-path cross-sectional area; and
- a single middle region having a magnetic-path cross-sectional area smaller than the magnetic-path cross-sectional area of the basic region, the middle region being disposed in a region near a middle portion of the wound portion in an axial direction thereof, the region including the middle portion, the middle region being provided in one core piece, and the inner resin portion is formed by charging a constituent resin into a ring-shaped groove formed by a step between the basic region and the middle region, and includes a thick portion with a thickness larger than a thickness of an area covering the basic region.

The above-described reactor includes the resin mold portion that covers the inner core portion with the wound portion exposed, and accordingly, insulation properties between the wound portion and the inner core portion can be increased by the inner resin portion. In the case of cooling the reactor with a cooling medium such as a liquid coolant, the wound portion can be brought into direct contact with the cooling medium, and thus, the reactor has excellent heat dissipation.

In particular, in the above-described reactor, the thickness of the inner resin portion is not uniform over the overall length of the inner core portion, and a thick portion is provided at a position on the inner core portion near the middle portion of the wound portion in the axial direction. This thick portion is thicker than an area of the resin mold portion that covers the basic region of the inner core portion, and is continuously formed to have a ring shape along the aforementioned ring-shaped groove. It can therefore be said that the thick portion is unlikely to crack. The thick portion is provided on the outer periphery of at least one core piece. That is to say, the thick portion is necessarily provided on the outer periphery of an area other than a seam area between core pieces. For this reason as well, cracking is unlikely to occur as described below. The above-described reactor has the aforementioned thick portion at a weak point, in terms of mechanical strength, on the resin mold portion. For this reason, even if thermal stress, external vibration, or the like is applied to the resin mold portion, cracking is unlikely to occur in the resin mold portion that includes the thick portion. Accordingly, the reactor has excellent strength.

For example, core pieces can be connected to each other by chamfering peripheral edges at end faces of the core pieces, or placing, between the core pieces, a gap plate that has a planar area smaller than or equal to that of the end face of each core piece. In this case, a ring-shaped recessed portion that is continuous in the circumferential direction of the core pieces can be formed at the seam area between the core pieces. If the resin mold portion is formed in this state, as a result of the constituent resin of the resin mold portion being charged into the recessed portion, a ring-shaped thick area that is thicker than an area other than the recessed portion can be formed at the seam area between the core pieces. However, cracking may occur in the thick area due to thermal stress, external vibration, or the like being applied to the resin mold portion, and the aforementioned thick area being pulled by the core pieces when adjacent core pieces are pulled in directions moving away from each other, for example. In contrast, if a locally thick area is provided in the resin mold portion at a position shifted from the seam area between the core pieces, i.e. a position on one of the core pieces that is distant from its end face and a region there-around, cracking is unlikely to occur in the thick portion even if thermal stress, external vibration, or the like is applied to the resin mold portion. For the above reason, the thick portion provided in the above-described reactor includes a region that is provided on the outer periphery of one core piece. Note that this thick portion is allowed to include a region provided on the outer periphery of the seam area between the core pieces.

If the resin mold portion is formed by means of the aforementioned bidirectional charging, the merging area of the molding material is typically included in the thick portion. For this reason, in this case as well, the above-described reactor has excellent strength of the aforementioned merging area.

(2) An example of the above-described reactor may be a mode in which the core piece includes both the middle region and the basic region that sandwiches the middle region.

In the above mode, the core piece that is provided with the ring-shaped groove portion is included, and it can be said that the thick portion that is provided on the outer periphery of the groove portion of this core piece is not provided on the outer periphery of the seam area between core pieces. For this reason, in the above mode, the thick portion is more unlikely to crack even if the aforementioned thermal stress, external vibration, or the like is applied thereto, and excellent strength is achieved.

(3) An example of the above-described reactor may be a mode in which the inner core portion includes a first core piece including the middle region, and two second core pieces including the basic region and sandwiching the first core piece.

In the above mode, due to the first core piece being sandwiched by the two second core pieces, a ring-shaped groove portion is formed by the middle region of the first core piece and the basic regions of the second core pieces. That is to say, in the above mode, it can be said that the thick portion is provided on the outer periphery of the ring-shaped groove portion that is formed by the three core pieces. A portion of this thick portion is provided on the outer periphery of the seam area between core pieces, but the remaining portion of the thick portion is provided on the outer periphery of an area other than the seam area, or more specifically, an intermediate portion of the first core piece that is distant from end faces thereof. For this reason, the above mode achieves excellent strength. In addition, in the above mode, the core pieces do not need to be grooved core pieces, and may be molded bodies with a simple shape, such as a rectangular-parallelepiped shape or a cylindrical shape. Thus, excellent manufacturability of the core pieces is also achieved.

(4) An example of the reactor described in (3) above in which the inner core portion includes a plurality of core pieces may be a mode in which gap portions are provided between the first core piece and the second core pieces.

In the above mode, magnetic saturation is unlikely to occur due to the gap portions being included, and, in addition, loss that derive from leakage flux can also be readily reduced due to the gap portions being provided in the wound portion. Also, in the above mode, the gap portions are included in the seam area between the core pieces, and a portion of the thick portion is provided on the outer periphery of the seam area between the core pieces, as mentioned above. However, the remaining portion of the thick portion is provided on the outer periphery of the area other than the aforementioned seam area, and thus, excellent strength is achieved.

(5) An example of the above-described reactor may be a mode in which the thick portion includes an area where fluid resin used to form the resin mold portion merges.

In the above mode, the resin mold portion includes the merging area of fluid resin (molding material), but the merging area is included in the thick portion. For this reason, the merging area is formed to be thicker than the area other than the merging area. Accordingly, in the above mode, the merging area is unlikely to crack even if thermal stress, external vibration, or the like is applied to the resin mold portion, and excellent strength is achieved. In addition, in the above mode, even though the resin mold portion is formed by means of bidirectional charging, the charging time of the molding material can be shortened when the resin mold portion is formed, and excellent manufacturability is also achieved.

(6) An example of the above-described reactor may be a mode in which the inner core portion includes at least one of a resin core piece that is a molded body made of a composite material containing magnetic powder and resin, and a green compact core piece that is a green compact molded body.

If a resin core piece is provided in the above mode, even a core piece with an uneven shape, such as a grooved core piece mentioned above in (2) above, can be readily formed by means of injection molding or the like, and excellent manufacturability is achieved. If a green compact core piece is provided, the size of the magnetic core and the reactor can be reduced since a green compact molded body can more readily increase magnetic permeability than a molded body that is made of a composite material, and thus a small-sized core piece can be readily made.

DETAILS OF EMBODIMENTS OF PRESENT DISCLOSURE

Hereinafter, embodiments of the present disclosure will be described in detail with reference to the drawings. The same reference numerals in the drawings refer to items with the same name.

Embodiment 1

A reactor 1A according to Embodiment 1 will be described with reference to FIGS. 1 to 3.

The following description will be given, assuming that the lower side refers to the installation side, i.e. the side on which the reactor 1A comes into contact with an installation target, and the upper side refers to the side opposite to the installation side. FIG. 2 shows, as an example, a case where the lower side of paper is the side on which the reactor 1A is installed. FIG. 2 shows a vertical cross-section of a wound portion 2*a* taken along a plane parallel to an axial direction thereof, and shows a state where an inner resin portion 61 is exposed.

A dash-dot line shown on wound portions 2*a* and 2*b* in FIGS. 1 and 2 and later-described FIG. 4 denotes the middle portions of the wound portions 2*a* and 2*b* in the axial direction.

SUMMARY

As shown in FIG. 1, the reactor 1A according to Embodiment 1 includes a coil 2, a magnetic core 3 that forms a closed magnetic circuit, and a resin mold portion 6 (resin mold) that at least partially covers the magnetic core 3. In this example, the coil 2 has two wound portions 2*a* and 2*b*. The wound portions 2*a* and 2*b* are disposed side-by-side with their axes parallel to each other. The magnetic core 3 includes inner core portions 31 (inner cores) that are disposed within the wound portions 2*a* and 2*b*. The resin mold portion 6 includes inner resin portions 61 (inner resins) that are interposed between the wound portions 2*a* and 2*b* and the inner core portions 31, and at least partially cover the respective inner core portions 31. The resin mold portion 6 does not cover outer-peripheral faces of the wound portions 2*a* and 2*b*, but exposes these wound portions 2*a* and 2*b*. This reactor 1A is typically attached, when in use, to an installation target (not shown), such as a converter case.

In particular, in the reactor 1A according to Embodiment 1, an area of each of the inner core portions 31 that is disposed near the middle portion of the respective wound portions 2*a* and 2*b* in the axial direction thereof is partially thin. This thin area (later-described middle region 3C) is provided in one core piece (in this example, inner core piece 310). Each of the inner resin portions 61 includes a thick portion 61C that is formed by charging a constituent resin into a ring-shaped groove, which is formed by a step between the aforementioned thin area and relatively thick areas (later-described basic regions 3S). That is to say, in the reactor 1A, each of the inner core portions 31 has a specific shape and size, and the ring-shaped thick portion 61C is provided at a specific position on each of the inner core portions 31. For this reason, even if, for example, thermal stress, external vibration, or the like is applied to the resin mold portion 6, cracking is unlikely to occur in the resin mold portion 6. Each constituent element will be described below in detail.

Coil

The coil 2 in this example includes the wound portions 2*a* and 2*b* that are cylindrical and are formed by helically winding wires. The following modes of the coil 2 that includes the two wound portions 2*a* and 2*b* arranged side-by-side are possible:

(α) a mode of the coil 2 that includes wound portions 2*a* and 2*b* that are formed with one continuous wire, and a connecting portion that is constituted by a portion of the wire spanning between the wound portions 2*a* and 2*b* and connects the wound portions 2*a* and 2*b* to each other; and (β) a mode of the coil 2 that includes wound portions 2*a* and 2*b* that are formed respectively with two independent wires, and a joint portion that is formed by joining an end portion, which is one of the two end portions that are pulled out of the wound portion 2*a*, to an end portion, which is one of the two end portions that are pulled out of the wound portion 2*b*, by means of welding, crimping, or the like.

In both modes, the end portions of the wires pulled out from the wound portions 2*a* and 2*b* (in the mode (3), the other end portions) are used as connecting portions to which an external device, such as a power supply, is connected.

Examples of the wires may include a coated wire that includes a conductive wire that is made of copper or the like, and an insulating coating that is made of a resin such as polyamideimide and covers the outer periphery of the conductive wire. The wound portions 2*a* and 2*b* in this example are edgewise coils that have a square-columnar shape and are formed by winding, edgewise, wires that are coated rectangular wires, and have the same specifications including the shape, winding direction, turning number, and so on. The shape, size, and so on, of the wires and the wound portions 2*a* and 2*b* may be selected as appropriate. For example, the wires may be coated round wires, and the shape of the wound portions 2*a* and 2*b* may be a cylindrical shape, or a columnar shape that does not have corner portions, such as an oval shape or a race track shape. Also, the wound portions 2*a* and 2*b* may have different specifications.

In the reactor 1A according to Embodiment 1, the entire outer-peripheral faces of the wound portions 2*a* and 2*b* are not covered by the resin mold portion 6 and are exposed. Meanwhile, the inner resin portions 61, which are portions of the resin mold portion 6, are provided within the wound portions 2*a* and 2*b*, and inner-peripheral faces of the wound portions 2*a* and 2*b* are covered by the resin mold portion 6.

Magnetic Core

Summary

The magnetic core 3 in this example includes inner core portions 31 that are disposed in the respective wound portions 2*a* and 2*b*, and outer core portions 32 that are disposed outside the wound portions 2*a* and 2*b*. The magnetic core 3 in this example is formed by fitting four core pieces (two inner core pieces 310 and two outer core pieces) to each other to form a ring shape, and the outer periphery of the magnetic core 3 is integrally held by being covered by the resin mold portion 6. This magnetic core 3 has a gapless structure in which a magnetic gap is substantially not included between the core pieces.

In the reactor 1A according to Embodiment 1, the magnetic-path cross-sectional area of each of the inner core portions 31 is not uniform over the overall length thereof, and partially varies. Each of the inner core portions 31 has an area in which the magnetic-path cross-sectional area is relatively small, near the center of the wound portion 2*a* (or 2*b*; only the wound portion 2*a* will be referred to in this paragraph and the next paragraph) in the axial direction thereof. More specifically, the inner core portion 31 has basic regions 3S, each of which has a predetermined magnetic-path cross-sectional area Ss, and a middle region 3C that has a magnetic-path cross-sectional area Sc smaller than the magnetic-path cross-sectional area Ss of each basic region 3S. The middle region 3C, which is an area in which the magnetic-path cross-sectional area is relatively small, is a region disposed near the middle portion of the wound portion 2*a*, including the middle portion thereof in the axial direction. In addition, the middle region 3C is a region that is provided in one core piece (in this example, a later-described inner core piece 310).

Here, "Near the middle portion of the wound portion 2*a*, including the middle portion thereof in the axial direction" refers to a region from the middle portion of the wound portion 2*a* in the axial direction, the middle portion serving as the center, to a point that corresponds to 10% of the length L of the wound portion 2*a*. That is to say, "near the center" refers to a region that includes the center and has a length that corresponds to 20% of the length L of the wound portion 2*a*. The length L is a length of the wound portion 2*a* in the axial direction. The middle region 3C "being disposed near the center" refers to the middle region 3C at least partially overlapping a region around the center.

The inner core portion 31, due to having these two basic regions 3S that sandwich the middle region 3C, has a ring-shaped groove (groove portion 312) that is formed by steps between the basic regions 3S and the middle region 3C. The ring-shaped groove portion 312 serves as an area in which the thick portion 61C of the resin mold portion 6 is formed. The inner core portion 31 in this example includes an inner core piece 310 that has both the middle region 3C and the two basic regions 3S that sandwich the middle region 3C.

In the following description, the inner core portion 31 (inner core piece 310) and the outer core portion 32 (outer core piece) will be described in this order.

Inner Core Portion

In this example, one inner core portion 31 is constituted mainly by one columnar inner core piece 310. End faces 31*e* of each inner core piece 310 are joined to inner end face 32*e* of outer core pieces that constitute the outer core portions 32 (FIG. 2). Note that, in this example, later-described interposed members 5 are disposed at seam areas between the core pieces.

The inner core pieces 310 in this example have the same shape and the same size. Specifically, each inner core piece 310 has a rectangular-parallelepiped shape as shown in FIG. 3, and is a grooved core piece on which the ring-shaped groove portion 312 is formed at an intermediate portion that is distant from the two end faces 31*e*, the groove portion 312 being continuous in the circumferential direction of the intermediate portion. The region of each inner core piece 310 in which the groove portion 312 is formed corresponds to the middle region 3C, and regions other than the region in which the groove portion 312 is formed correspond to the basic regions 3S. The shape of the inner core pieces 310 can be changed as appropriate. For example, the inner core pieces 310 may have a cylindrical shape, a polygonal columnar shape such as hexagonal columnar shape, or the like. In a case where the inner core piece 310 has a rectangular columnar shape, it is conceivable, as an example, that corner portions of the inner core pieces 310 may be C-chamfered, or may be R-chamfered as shown in FIG. 3. As a result of the corner portions being chamfered, the inner core pieces 310 are unlikely to break and has higher strength. In addition, a reduction in the weight and an increase in the contact area between the inner core piece 310 and the inner resin portion 61 can be achieved. Note that FIG. 3 emphasizes the groove portion 312 such that it can be readily recognized.

Each of the basic regions 3S in this example has a predetermined magnetic-path cross-sectional area Ss over its overall length. Thus, the magnetic core 3 can secure a sufficient portion with the magnetic-path cross-sectional area Ss and have predetermined magnetic characteristics.

If the middle region 3C is excessively large, the ratio of the portion with a magnetic-path cross-sectional area Sc that is smaller than the magnetic-path cross-sectional area Ss is large in the magnetic core 3, and thus, it may be likely that magnetic saturation occurs and leakage flux from the middle region 3C increases. Meanwhile, the larger the middle region 3C is, the more readily the thick portion 61C can be made large, and the more readily the strength can be increased. Considering magnetic characteristics, such as magnetic saturation and leakage flux, and also strength, it is conceivable, as an example, that the length of the middle region 3C (=the opening width of the groove portion 312) is 1% or more and 35% or less of the length L of the wound portions 2*a* and 2*b*, or furthermore, 5% or more and 20% or less, or 15% or less. Also, considering the aforementioned magnetic characteristics and strength, it is conceivable, as an example, that the depth of the groove portion 312 is selected such that the magnetic-path cross-sectional area Sc of the middle region 3C is 60% or more and less than 100% of the magnetic-path cross-sectional area Ss of each basic region 3S, or furthermore, 65% or more and 98% or less, or 70% or more and 95% or less. Alternatively, it is conceivable, as an example, that the depth of the groove portion 312 is 0.1 mm or more and 2 mm or less, or furthermore, 0.5 mm or more and 1.5 mm or less, or 1.2 mm or less. Note that the length of the middle region 3C is a length in the axial direction of the inner core portion 31 (that is equal to the axial direction of the wound portions 2*a* and 2*b*). The depth of the groove portion 312 is a length in a direction orthogonal to the axial direction of the inner core portion 31.

The cross-sectional shape of the groove portion 312 in this example is a trapezoidal shape whose opening width narrows toward the depth direction from an opening edge of the groove portion 312, but may be changed as appropriate. For example, the cross-sectional shape of the groove portion 312 may be a semicircular shape, a V-shape, or the like.

Furthermore, the position of the middle region 3C may differ between the inner core pieces 310 in areas that overlap near the middle portion, and the cross-sectional shape, opening width, depth, and so on, of the groove portion 312 may differ therebetween. If the inner core pieces 310 have the same shape and the same size as those in this example, the core pieces can be manufactured using the same mold, and conditions can be readily adjusted when the resin mold portion 6 is formed. For this reason, the inner core pieces 310 with the same shape and the same size have excellent manufacturability.

Outer Core Portion

In this example, each one of the outer core portions 32 is mainly constituted by a single columnar outer core piece. The two outer core pieces are disposed to sandwich the inner core pieces 310, which are arranged side-by-side, and are fitted to form a ring shape (FIG. 1).

Figure 2:
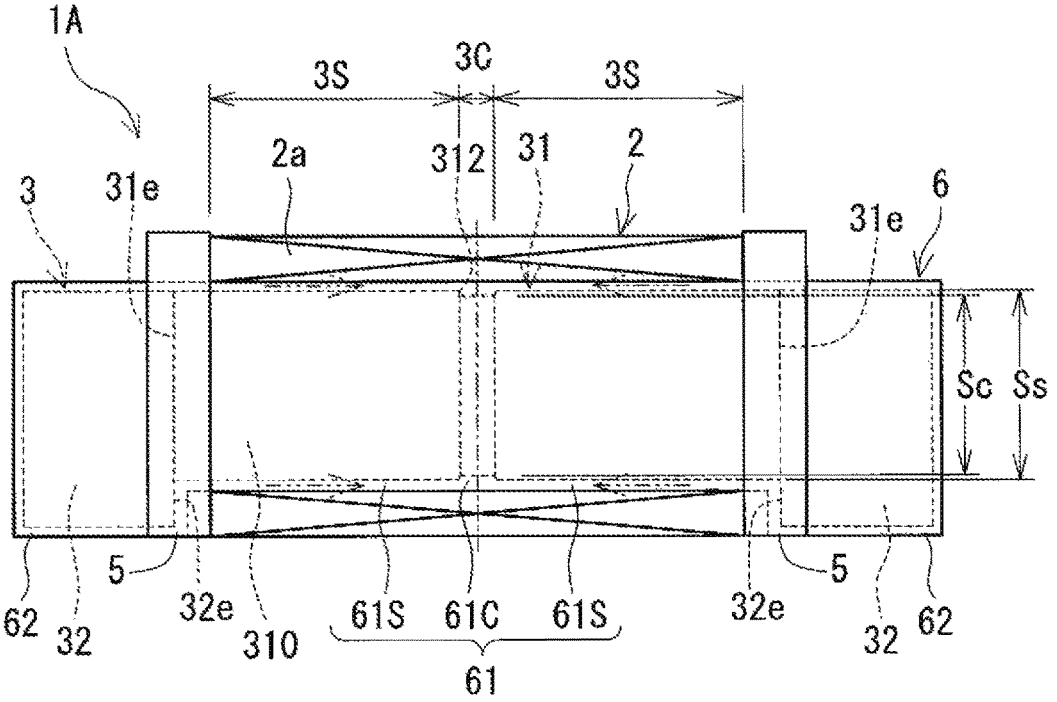
FIG. 2 is a schematic side view of the reactor according to Embodiment 1.
Figure 3:
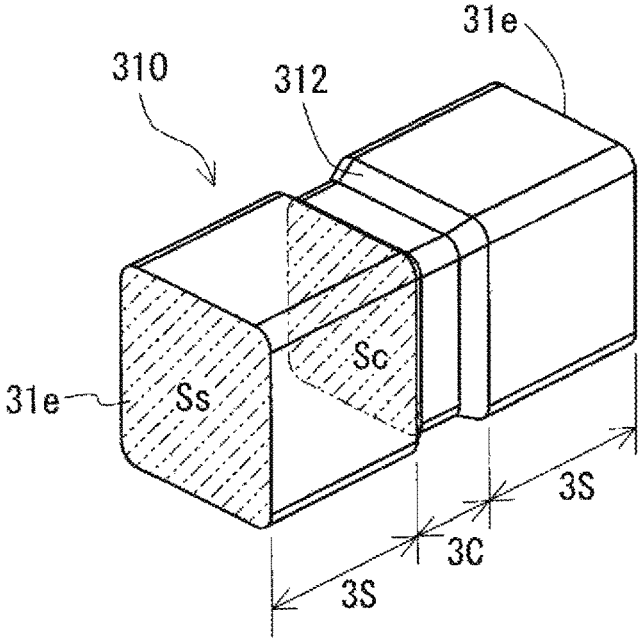
FIG. 3 is a perspective view of an inner core piece that is included in the reactor according to Embodiment 1.

Both of the outer core pieces in this example have the same shape and the same size, and have a rectangular-parallelepiped shape as shown in FIGS. 1 and 2. One face (inner end face 32*e*) of each outer core piece is used as a face to which a corresponding one of the inner core pieces 310 is joined. As shown in FIG. 2, each outer core piece in this example has a lower face, which is located on the installation side and protrudes toward an installation target side relative to lower faces of the inner core pieces 310 located on the installation side, and has an upper face on the opposite side that is flush with upper faces of the inner core pieces 310. This outer core piece has a magnetic-path cross-sectional area that is larger than or equal to the magnetic-path cross-sectional area Ss of each of the basic regions 3S of the inner core piece 310, and thus leakage of magnetic flux can be readily reduced.

The shape of the outer core pieces can be changed as appropriate. For example, it is conceivable, as an example, that each of the outer core pieces has a shape with outer corner portions that are C-chamfered or R-chamfered greatly, to some extent, e.g. has a trapezoidal shape or a doom shape in a plan view (top view). In a plan view, the outer corner portions of the outer core pieces that are distant from the wound portions 2*a* and 2*b* are in a region through which magnetic flux hardly passes, and thus, magnetic characteristics are unlikely to deteriorate even if the corner portions are chamfered as mentioned above, and moreover, it is possible to reduce the weight and increase the area in which the outer core pieces are in contact with an outer resin portion 62.

Material

Examples of the core pieces (here, inner core pieces 310 and outer core pieces) that constitute the magnetic core 3 may include molded bodies that contain a soft magnetic material, such as any of soft magnetic metals including iron, and an iron alloy (Fe—Si alloy, Fe—Ni alloy etc.). Specific examples of each core piece may include: a resin core piece that is a molded body made of a composite material containing magnetic powder, such as soft magnetic material powder or coated powder that includes insulating coating, and resin; a green compact core piece that is a green compact molded body formed by compacting and molding the magnetic powder; a ferrite core piece that is a sintered body of a soft magnetic material; a steel core piece that is a laminated body formed by laminating soft magnetic metal plates, such as electromagnetic steel plates; and the like. The magnetic core 3 may be in either of a single mode that includes a single type of core piece that is selected from a group including the aforementioned resin core piece, green compact core piece, ferrite core piece, and steel core piece, and a mixed mode that includes a plurality of types of core pieces selected from the above group. If each of the inner core portions 31 and the outer core portions 32 includes a plurality of core pieces, either the single mode or the mixed mode may be employed.

The content of the magnetic powder in the aforementioned composite material that constitutes a resin core piece is, for example, 30 volume % or more and 80 volume % or less, and the content of the resin is, for example, 10 volume % or more and 70 volume % or less. From the viewpoint of an increase in saturation magnetic flux density and heat dissipation, the content of the magnetic powder may be 50 volume % or more, or furthermore, 55 volume % or more, or 60 volume % or more. From the viewpoint of an increase in the fluidity during the manufacturing process, the content of the magnetic powder may be 75 volume % or less, or furthermore, 70 volume % or less, and the content of the resin may be more than 30 volume %.

Examples of the resin in the aforementioned composite material may include thermosetting resin, thermoplastic resin, cold setting resin, low-temperature setting resin, and the like. Examples of the thermosetting resin may include unsaturated polyester resin, epoxy resin, urethane resin, silicone resin, and the like. Examples of the thermoplastic resin may include polyphenylene sulfide (PPS) resin, polytetrafluoroethylene (PTFE) resin, crystal polymer (LCP), polyamide (PA) resin such as nylon 6 or nylon 66, polybutylene terephthalate (PBT) resin, acrylonitrile-butadiene-styrene (ABS) resin, and the like. In addition, BMC (bulk molding compound), which is obtained by mixing calcium carbonate or glass fiber with unsaturated polyester, minable silicone rubber, millable urethane rubber, and the like, may also be used.

Heat dissipation can be further enhanced if the above composite material contains non-magnetic, non-metal powder (filler) such as alumina or silica powder, in addition to the magnetic powder and the resin. The content of the non-magnetic, non-metal powder may be, for example, 0.2 mass % or more and 20 mass % or less, or furthermore, 0.3 mass % or more and 15 mass % or less, or 0.5 mass % or more and 10 mass % or less.

A molded body of the aforementioned composite material can be manufactured using an appropriate molding method, such as injection molding or cast molding. Thus, a molded body with an uneven shape, such as a grooved core piece, can be molded readily and accurately.

Examples of the aforementioned green compact molded body may include, typically, a green compact molded body obtained by compressing and molding mixed powder that contains magnetic powder and a binder into a predetermined shape, and furthermore, a green compact molded body obtained by performing heat treatment after molding. The binder may be resin or the like, and the content thereof may be, for example, 30 volume % or less. If heat treatment is performed, the binder may disappear or may be thermally denatured. With the green compact molded body, the content of magnetic powder can be more readily increased (e.g. to more than 80 volume %, or furthermore, 85 volume % or more) than a composite material molded body, and a core piece with a higher saturation magnetic flux density can be more readily obtained.

This example employs the mixed mode in which the inner core pieces 310 are resin core pieces and the outer core pieces are green compact core pieces, but the mode may be changed as appropriate.

Interposed Members

The reactor 1A in this example further includes interposed members 5 that are interposed between the coil 2 and the magnetic core 3. The interposed members 5 are typically made of an insulating material, and function as insulating members between the coil 2 and the magnetic core 3, and members for positioning the inner core pieces 310 and the outer core pieces with respect to the wound portions 2*a* and 2*b*, for example. The interposed members 5 in this example are members with a rectangular frame shape within which the seam areas between the inner core pieces 310 and the outer core pieces and a region around the seam areas are disposed, and also function as members for forming a flow path for the molding material when the resin mold portion 6 is formed.

For example, each of the interposed members 5 includes open holes, a support portion, a coil groove portion, and a core groove portion (see an outer interposed portion 52 in JP 2017-135334A for an interposed member with a similar shape), which are described below. The open holes penetrate the interposed member 5 from the sides on which the outer core pieces are disposed (hereinafter referred to as "outer core side") to the side on which the wound portions 2*a* and 2*b* are disposed (hereinafter referred to as "coil side"), and the inner core pieces 310 are inserted into the open holes. The support portion partially protrudes from an inner-peripheral face that forms the open holes, and supports portions (in this example, four corner portions) of the inner core pieces 310. The coil groove portion is provided on the coil side of each interposed member 5, and end faces and regions therearound of the wound portions 2*a* and 2*b* are fitted into the coil groove portion. The core groove portion is provided on the outer core side of the interposed member 5, and inner end faces 32*e* and regions therearound of an outer core piece are fitted into the core groove portion.

With the wound portions 2*a* and 2*b* fitted into the coil groove portions, the inner core pieces 310 inserted into the respective open holes, and the end faces 31*e* in contact with the inner end faces 32*e* of the outer core pieces that are fitted into the core groove portions, the shape and the size of the interposed members 5 are adjusted such that a flow path for the molding material is provided. To provide a flow path for the molding material, for example, it is conceivable to provide gaps provided between areas of the inner core pieces 310 that are not supported by the support portion and the inner-peripheral face of the open holes, and between the outer core pieces and the core groove portions. The flow path for the molding material is provided such that the molding material does not leak onto the outer-peripheral faces of the wound portions 2*a* and 2*b*. As long as the interposed members 5 have the aforementioned functions, the shape, size, and the like of the interposed members 5 may be selected as appropriate, and a known configuration may be referenced.

Examples of the constituent material of the interposed members 5 may include an insulating material, such as any of various resins. For example, any of the various thermoplastic resins and thermosetting resins described in the section of the composite material that constitute the resin core pieces may be used. The interposed members 5 can be manufactured using any known molding method, such as injection molding.

Resin Mold Portion

Summary

The resin mold portion 6 has a function of covering the outer periphery of at least one of the core pieces that constitute the magnetic core 3, thus protecting the core pieces from the external environment, mechanically protecting the core pieces, and enhancing insulation properties between the core pieces and components surrounding the coil 2. The resin mold portion 6 in this example does not cover the outer periphery of the wound portions 2*a* and 2*b*, and exposes the wound portions 2*a* and 2*b*. Thus, for example, the wound portions 2*a* and 2*b* can be brought into direct contact with a cooling medium such as a liquid coolant, and heat dissipation of the reactor 1A can thus be enhanced.

The resin mold portion 6 in this example includes the outer resin portions 62 that cover the outer peripheries of the outer core portions that constitute the outer core portions 32, in addition to the inner resin portions 61 that cover the outer peripheries of the inner core portions 310 that constitute the inner core portions 31. Also, the resin mold portion 6 in this example is an integrated body obtained due to these resin portions 61 and 62 being integrally formed, and integrally holds an assembled set of the magnetic core 3 and the interposed members 5. In particular, in the reactor 1A according to Embodiment 1, each of the inner resin portions 61 includes a thick portion 61C.

The inner resin portions 61 and the outer resin portions 62 will be described below in this order.

Inner Resin Portions

Each of the inner resin portions 61 in this example is a cylindrical body that is formed due to the constituent resin of the resin mold portion 6 being charged into a cylindrical space (here, a square-cylindrical space) that is provided between the inner-peripheral face of the wound portion 2*a* (or 2*b*) and the outer-peripheral face of the inner core piece 310. Also, each of the inner resin portions 61 covers the substantially entire outer-peripheral face of an intermediate portion (here, a portion other than the portions disposed in the interposed members 5) of the inner core piece 310 that is distant from the two end faces 31*e*, and has a shape that corresponds to the outer shape of the inner core piece 310. Each of the inner resin portions 61 includes an area (thick portion 61C) that covers the middle region 3C of the inner core piece 310, and two areas (basic coating portions 61S) that cover the basic regions 3S.

The thickness of the inner resin portions 61 is not uniform over the overall length thereof, and partially varies. Specifically, the thickness tc of the area that covers the middle region 3C, i.e. the area that covers the groove portion 312 is larger than the thickness ts of the basic coating portions 61S that cover the basic regions 3S by the depth of the groove portion 312 (FIG. 1). The partially thick area that covers the middle region 3C is the thick portion 61C. The larger the thickness tc of the thick portion 61C is, the more readily the mechanical strength of the inner resin portions 61 can be increased, and it is possible to make the inner resin portions 61 unlikely to crack. Since the thickness tc of the thick portion 61C corresponds to the total of the thickness ts of the basic coating portions 61S and the depth of the groove portion 312, it is possible to make the inner resin portions 61 unlikely to crack, to a greater extent, by making at least one of the thickness ts and the depth larger. The larger the thickness ts of the basic coating portions 61S is, the more readily the effects such as protection of the core pieces from the external environment, mechanical protection thereof, and ensuring of insulation properties are achieved. On the other hand, it may lead to an increase in the weight and the size of the resin mold portion 6, and consequently, an increase in the weight and the size of the reactor 1A. The larger the depth of the groove portion 312 is, the aforementioned magnetic characteristics may deteriorate, for example. Accordingly, it is conceivable, as an example, that the aforementioned thicknesses tc and ts are selected while giving consideration to the weight, size, magnetic characteristics, strength, and so on. For example, it is conceivable, as an example, that the thickness ts of the basic coating portions 61S is 0.1 mm or more and 4 mm or less, or furthermore, 0.3 mm or more and 3 mm or less, or furthermore, 2.5 mm or less, 2 mm or less, or 1.5 mm or less. The thickness tc of the thick portion 61C may be adjusted based on the thickness ts and the aforementioned depth of the groove portion 312.

Outer Resin Portions

The outer resin portions 62 in this example cover, along the outer core pieces, the substantially entire outer-peripheral faces of the outer core pieces excluding the inner end faces 32*e* to which the inner core pieces 310 are connected and regions therearound, and have a substantially uniform thickness. The regions of the outer resin portions 62 that cover the outer core pieces, the thickness of these regions, and so on, may be selected as appropriate. The thickness of the outer resin portions 62 may be equal to the thickness ts of the basic coating portions 61S, or may differ from the thickness ts, for example.

Constituent Material

Examples of the constituent material of the resin mold portion 6 may include various resins, e.g. thermoplastic resins such as PPS resin, PTFE resin, LCP, PA resin, and PBT resin. If this constituent material is a composite resin that contains any of these resins and the aforementioned filler or the like with excellent heat conductivity, a resin mold portion 6 with excellent heat dissipation can be obtained. If the constituent resin of the resin mold portion 6 and the constituent resin of the interposed members 5 are the same resin, excellent joining properties is achieved therebetween. In addition, since the resin mold portion 6 and the interposed members 5 have the same thermal expansion coefficient, detachment, cracking, or the like due to thermal stress can be suppressed. Injection molding or the like can be used to mold the resin mold portion 6.

Method for Manufacturing Reactor

For example, the reactor 1A according to Embodiment 1 can be manufactured by fitting the coil 2, the core pieces (here, two inner core pieces 310 and two outer core pieces) that constitute the magnetic core 3, and the interposed member 5 to each other, accommodating the thus-assembled set into a mold (not shown) for the resin mold portion 6, and covering the core pieces with the molding material.

In this example, the aforementioned assembled set can be readily obtained by disposing the wound portions 2*a* and 2*b* on the coil side of the interposed members 5, inserting the inner core pieces 310 into the open holes, and disposing the outer core pieces on the core sides.

It is conceivable, as an example, to accommodate the aforementioned assembled set into the mold, and to perform bidirectional charging, as indicated by dash-double dot line arrows in FIG. 2. Specifically, the molding material is charged from end portions of the wound portions 2*a* and 2*b* via the outer core pieces, with outer end faces of the outer core pieces (in FIG. 2, a left end face of the left outer core piece and a right end face of the right outer core piece) serving as the position to start charging the molding material. If the aforementioned bidirectional charging is performed to form the resin mold portion 6, the molding material (fluid resin) collides with each other near the middle portions of the wound portions 2*a* and 2*b* in the axial direction, and a merging area of the molding material is provided near the aforementioned middle portions. This merging area is also a charging end position that the molding material ultimately reaches in the charging space. Since the groove portions 312 of each inner core piece 310 are disposed near the middle portions, the merging area is provided on the outer peripheries of the groove portions 312. That is to say, the merging area is included in the thick portions 61C that is formed to be thicker than the basic coating portions 61S.

Note that, to confirm that the resin mold portion 6 includes the merging area, the following method may be employed, for example. The resin mold portion 6 is cut out along a plane parallel to the axial direction of the wound portion 2*a* (or 2*b*), and the cross-section is observed using a microscope or the like to check whether or not a weld line is present.

Usage

The reactor 1A according to Embodiment 1 can be used as a component of a circuit that performs an operation to boost or reduce a voltage, such as a constituent component of any of various converters and power conversion devices. Examples of the converters may include a vehicle converter (typically, a DC-DC converter) that is to be mounted in a vehicle such as a hybrid vehicle, a plug-in hybrid vehicle, an electric vehicle, and a fuel-cell vehicle, as well as a converter for an air-conditioner.

Effects

The reactor 1A according to Embodiment 1 includes the thick portions 61C at positions on the inner resin portions 61 of the resin mold portion 6, near the middle portions of the wound portions 2*a* and 2*b* in the axial direction. The thick portions 61C have a thickness larger than the thickness is of the basic coating portions 61S, and are each provided to form a ring shape. In addition, each of the thick portions 61C is provided on the outer periphery of one core piece (here, a corresponding one of the inner core pieces 310), and is thus unlikely to crack. The reactor 1A according to Embodiment 1, which has these thick portions 61C at areas of the resin mold portion 6 in which mechanical strength is small, has excellent strength. This is because, even if thermal stress, external vibration, or the like is applied to the resin mold portion 6, cracking is unlikely to occur in the resin mold portion 6 that includes the thick portions 61C. In particular, in the reactor 1A in this example, the thick portions 61C include a molding material merging area, whereas the thick portions 61C are formed to be thicker than areas other than the merging area (here, mainly, the basic coating portions 61S). Thus, even if thermal stress, external vibration, or the like is applied to the resin mold portion 6, cracking is unlikely to occur in the merging area. Accordingly, the reactor 1A has excellent strength.

Also, in the reactor 1A according to Embodiment 1, insulation properties between the wound portions 2*a* and 2*b* and the inner core portions 31 (inner core pieces 310) are enhanced by the inner resin portions 61. Also, in this example, the wound portions 2*a* and 2*b* are not covered by the resin mold portion 6 and are exposed, and thus can be brought into direct contact with a cooling medium such as a liquid coolant, for example. Accordingly, the reactor 1A also has excellent heat dissipation.

The reactor 1A in this example also exhibits the following effects.

(1) The reactor 1A has grooved core pieces, and each of the thick portions 61C is not provided on the outer periphery of a seam area between the core pieces, and accordingly, the thick portions 61C are more unlikely to crack. Thus, excellent strength is achieved.

(2) The number of core pieces that constitute the magnetic core 3 is small, and the number of components to be fitted is also small (in this example, seven components in total; namely the coil 2, the core pieces, and the interposed members 5). Thus, excellent operability is achieved.

(3) With a small number of core pieces that constitute the magnetic core 3, the number of joint areas between the core pieces is small. Moreover, the resin mold portion 6 includes the inner resin portions 61 and the outer resin portions 62, and the inner resin portions 61 and the outer resin portions 62 are continuously and integrally formed. Thus, the magnetic core 3 that is covered by the resin mold portion 6 is more rigid as an integrated body, and has excellent strength.

(4) By employing resin core pieces as the inner core pieces 310 with an uneven shape, such as grooved core pieces, the inner core pieces 310 can be readily and accurately molded by means of injection molding or the like, and thus, excellent manufacturability of the inner core pieces 310 is achieved. Also, resin core pieces which contain resin, are also excellent in anti-corrosion properties.

(5) By employing resin core pieces as the inner core pieces 310 and employing green compact core pieces as the outer core pieces, the size of the magnetic core 3 can be readily reduced and a small-sized reactor 1A can be obtained, compared with a case of employing the single mode using resin core pieces.

(6) Excellent anti-corrosion properties are achieved by employing green compact core pieces as the outer core pieces, and covering the substantially entire outer core pieces with the outer resin portions 62.

(7) The charging time can be shortened by forming the resin mold portion 6 by means of bidirectional charging, and thus, the reactor 1A has excellent manufacturability.

(8) Since the magnetic core 3 has a gapless structure, loss due to leakage flux at a gap portion does not substantially occur. Accordingly, a reactor 1A with little loss can be obtained.

Embodiment 2

A reactor 1B according to Embodiment 2 will be described below with reference to FIG. 4.

Figure 4:
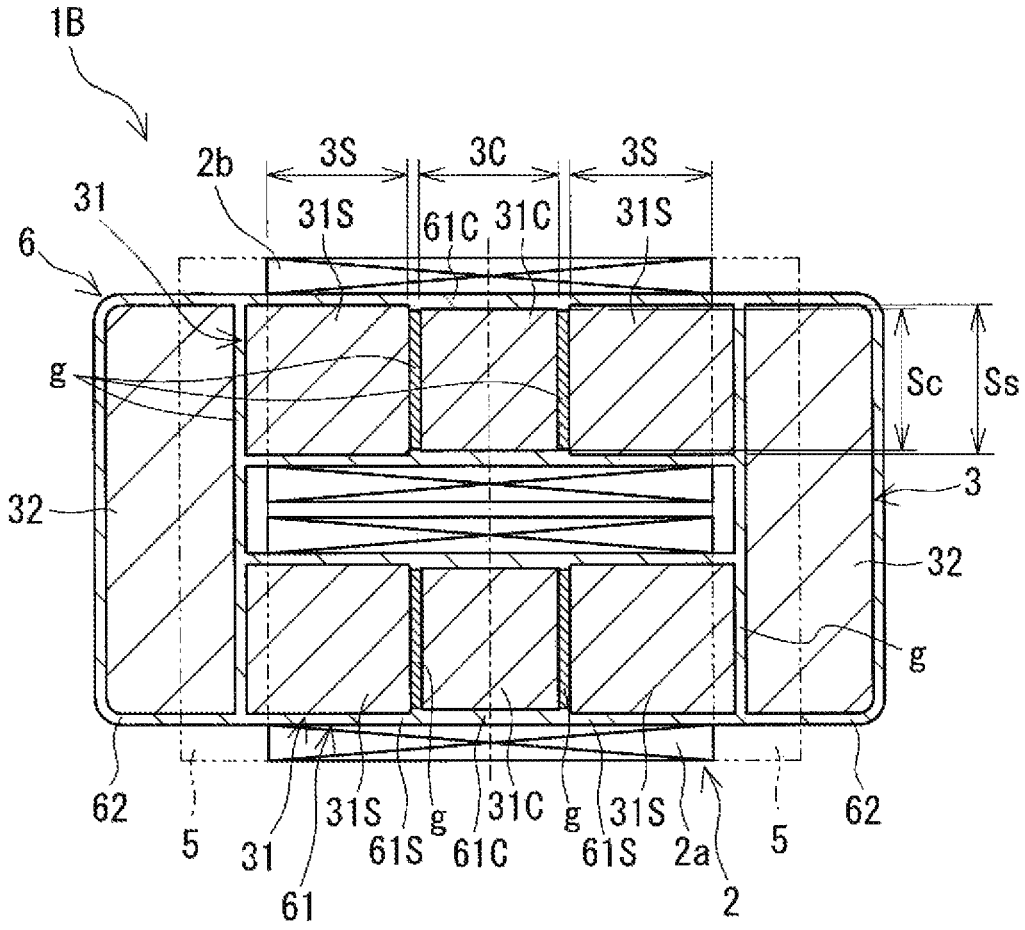
FIG. 4 is a schematic cross-sectional view of a reactor according to Embodiment 2.

FIG. 4 is a cross-sectional view of the reactor 1B taken along a plane parallel to the axial direction of the wound portions 2*a* and 2*b* of the coil 2 and also parallel to the direction in which the wound portions 2*a* and 2*b* are arranged (in FIG. 4, the vertical direction). In FIG. 4, the interposed members 5 are virtually indicated by dash-double dot lines.

The basic configuration of the reactor 1B according to Embodiment 2 is the same as that of Embodiment 1, and the reactor 1B includes the coil 2, the magnetic core 3, and the resin mold portion 6. The magnetic core 3 includes the inner core portions 31 and the outer core portions 32. Regions of the inner core portions 31 near the middle portions of the wound portions 2*a* and 2*b* in the axial direction are partially thin. The resin mold portion 6 includes the inner resin portions 61 and the outer resin portions 62. Each of the inner resin portions 61 includes a thick portion 61C that covers the outer periphery of the aforementioned thin region. One difference between the reactor 1B according to Embodiment 2 and Embodiment 1 lies in core pieces that constitute the inner core portions 31. Each of the inner core portions 31 does not include a grooved core piece, but includes a plurality of core pieces 31C and 31S that have different magnetic-path cross-sectional areas. Another one difference lies in the thick portion 61C, and this thick portion 61C also includes a portion provided on the outer periphery of seam areas between the core pieces 31C and 31S. In the following description, the aforementioned differences will be described in detail, and detailed descriptions of other configurations, effects, and so on are omitted.

Each of the inner core portions 31 includes a first core piece 31C and two second core pieces 31S. The first core piece 31C includes the middle region 3C. The two second core pieces 31S sandwich the first core piece 31C. In this example, both the core pieces 31C and 31S have a rectangular-parallelepiped shape, and have uniform magnetic-path cross-sectional areas Sc and Ss, respectively, over their overall lengths. Thus, it can be said that both the core pieces 31C and 31S have a simple shape, and have excellent manufacturability. The shape of the core pieces 31C and 31S may be changed, as appropriate, and the core pieces 31C and 31S may have a cylindrical shape, for example. Also, the shape of the core pieces 31C and 31S may also be made different in a range where the core pieces 31C and 31S have the magnetic-path cross-sectional areas Sc and Ss. In this example, the number of core pieces that constitute one inner core portion 31 is three, but may alternatively be four or more.

The second core pieces 31S are coaxially disposed on two sides of the first core piece 31C. As a result, ring-shaped groove portions that are continuous in the circumferential direction of each inner core portion 31 can be formed by an outer-peripheral face of the first core piece 31C and end faces of the second core pieces 31S that sandwich the first core piece 31C. Due to at least a portion of each first core piece 31C being disposed near the middle portion of the wound portion 2*a* (or 2*b*), the groove portions constitute areas in which the thick portion 61C is formed. The length of the middle region 3C corresponds to the length of the first core piece 31C, and the depth of the groove portions corresponds to the difference in height between the core pieces 31C and 31S that are coaxially disposed. Accordingly, the size of the groove portions can be readily changed to a predetermined size by adjusting the sizes of the core pieces 31C and 31S (the length of the core piece 31C, the magnetic-path cross-sectional areas Sc and Ss, ½ of the difference in height in a state where the core pieces 31C and 31S are coaxially disposed, etc.). For the opening width and the depth of the groove portion, the opening width and the depth of the groove portion 312 in Embodiment 1 may be referenced.

All of the core pieces 31C and 31S and the outer core pieces in this example are in the single mode using green compact core pieces, but the mode may be changed as appropriate. In the single mode using green compact core pieces, it is favorable that gap portions g are provided since magnetic saturation is then unlikely to occur. In this example, the gap portions g are provided between the core pieces 31C and 31S. The thickness of the gap portion g may be selected as appropriate, in accordance with the saturation magnetic flux density of the core pieces or the like. Examples of the gap portions g may include gap plates that are made of a non-magnetic material such as alumina, as in this example. By accommodating the gap plates and the core pieces 31C and 31S in a stacked state in the wound portions 2*a* and 2*b*, and forming the resin mold portion 6, a state can be maintained where the gap plates are interposed between the core pieces 31C and 31S. The gap plates can also be joined to end faces of the core pieces using an adhesive or the like.

Alternatively, it is conceivable, as an example, that the gap portions g are formed by the constituent resin of the resin mold portion 6. In this case, the gap portions g can also be formed at the same time as when the resin mold portion 6 is formed, and moreover, the gap portions g can also be used as materials for joining the core pieces to each other. In the case where each inner core portion 31 includes the gap portions g constituted by the resin mold portion 6, it is conceivable, as an example, to provide inner interposed portions (not shown) that are interposed between the wound portions 2*a* and 2*b* and the inner core portions 31, and can hold the core pieces while separating the core pieces from each other to form the gap portions g constituted by the resin mold portion 6. Any known configuration may be used, as appropriate, for the shape of the inner interposed portions (e.g. see an inner interposed portion 51 in JP 2017-135334A). Although FIG. 4 shows, as an example, a case where the gap portions g constituted by the resin mold portion 6 are provided between the core pieces 31S and the outer core pieces, these gap portions g may be omitted, and a gap portion g may alternatively be provided only in the inner core portion 31.

For example, the reactor 1B according to Embodiment 2 can be manufactured by fitting the coil 2, the core pieces (here, the core pieces 31C and 31S, and the outer core pieces) that constitute the magnetic core 3, and the interposed members 5 to each other, and covering the core pieces with the molding material, similarly to Embodiment 1. It is conceivable, as an example, that the resin mold portion 6 is formed by means of bidirectional charging described in Embodiment 1. In this example, the resin mold portion 6 includes the gap portions g, and the aforementioned core pieces are integrally held.

In the reactor 1B according to Embodiment 2, the ring-shaped groove portions are formed due to the core pieces 31C, which has a relatively smaller magnetic-path cross-sectional area Sc, being sandwiched by the core pieces 31S, which have a relatively larger magnetic-path cross-sectional area Ss, and the thick portions 61C are provided on the outer peripheries of the entire outer-peripheral faces of the core pieces 31C. In the reactor 1B according to Embodiment 2 that includes the above-described thick portions 61C, cracking is unlikely to occur in the resin mold portion 6 that includes the thick portion 61C, even if thermal stress, external vibration, or the like is applied to the resin mold portion 6, similarly to the reactor 1A of Embodiment 1. Accordingly, the reactor 1B has excellent strength. Even if the thick portions 61C includes areas where the molding material merges, the reactor 1B has excellent strength.

In addition, in the reactor 1B according to Embodiment 2, although the areas where the thick portions 61C are formed include the outer peripheries of the seam areas between the core pieces 31C and 31S (which are, in this example, also areas where the gap portions g are formed), they also include the outer periphery of areas other than the seam areas, namely, intermediate portions that are distant from two end faces of each first core piece 31C. For this reason, the reactor 1B has excellent strength.

Also, the reactor 1B in this example includes the gap portions g and is thus unlikely to be magnetically saturated. Furthermore, since the gap portions g are mainly provided within the wound portions 2*a* and 2*b*, loss due to leakage flux can be readily reduced. Accordingly, a reactor 1B with little loss can be obtained.

Furthermore, in the reactor 1B in this example, all of the core pieces that constitute the magnetic core 3 are green compact core pieces, and thus, the size of the magnetic core 3 can be readily reduced compared with a case where the core pieces are in the single mode using resin core pieces. Accordingly, a small-sized reactor 1B can be obtained.

The present disclosure is not limited to the above examples.

For example, at least one of the following changes (a) to (e) may be made to the above-described Embodiments 1 and 2.

(a) A coil of a self-fusing type is provided.

In this case, wires with a fusion layer is used. After the wound portions 2*a* and 2*b* are formed, adjacent turns are joined by the fusion layer by heating the wound portions 2*a* and 2*b* to fuse and solidify the fusion layer. By employing a coil of a self-fusing type, the shape of the wound portions 2*a* and 2*b* can be maintained when, for example, the coil 2 and the magnetic core 3 are fitted. As a result, the reactors 1A and 1B with a coil of a self-fusing type have excellent operability.

(b) In Embodiment 1, each of the inner core portion 31 includes a plurality of inner core pieces, and gap portions interposed between the inner core pieces.

In this case, of the plurality of inner core pieces, an inner core piece disposed near the middle portions of the wound portions 2*a* and 2*b* in the axial direction includes the ring-shaped groove portion 312.

(c) The resin mold portion 6 is formed by means of unidirectional charging, with an end portion of each of the wound portions 2*a* and 2*b* serving as the position to start charging the molding material, and the other end portion serving as the position to end charging the molding material.

In this case, each of the thick portions 61C does not include an area where the molding material merges, and it is possible to make the thick portions 61C more unlikely to crack. As a result, reactors 1A and 1B with more excellent strength can be obtained.

(d) In Embodiments 1 and 2, all of the core pieces that constitute the magnetic core 3 are resin core pieces.

In this case, since the outer core pieces contain resin and have excellent anti-corrosion properties, it is conceivable, as an example, that the outer resin portions 62 are omitted, and the outer core pieces are provided with areas that are not covered by the outer resin portions 62 and are exposed. In the single mode using resin core pieces, magnetic saturation is unlikely to occur depending on the content of magnetic powder, and thus, a gapless structure can be employed as in Embodiment 1. Gap portions can also be provided as in Embodiment 2.

(e) At least one of the following items is provided:

(e1) a sensor (not shown) for measuring a physical quantity of the reactor, such as a temperature sensor, a current sensor, a voltage sensor, or a magnetic flux sensor;

(e2) a heat radiating plate (e.g. a metal plate etc.) that is attached to at least a portion of the outer-peripheral face of the coil 2;

(e3) a joint layer (e.g. an adhesive layer; an adhesive layer with excellent insulation properties is favorable) that is disposed between an installation face of the reactor and an installation target, or between the installation face and the heat radiating plate in (e2); and (e4) an attachment portion for fixing the reactor to an installation target, the attachment portion being formed integrally with the outer resin portions 62.

The invention claimed is:

1. A reactor comprising:

a coil having a wound portion;

a magnetic core that includes an inner core disposed in the wound portion, the magnetic core forming a closed magnetic circuit; and a resin mold including an inner resin that is interposed between the wound portion and the inner core, and at least partially covers the inner core, the resin mold not covering an outer-peripheral face of the wound portion;

the inner core including:

a basic region having a predetermined magnetic-path cross-sectional area; and a single middle region having a magnetic-path cross-sectional area smaller than the magnetic-path cross-sectional area of the basic region, the middle region being disposed in a region near a middle portion of the wound portion in an axial direction thereof, the region including the middle portion, the middle region being provided in one core piece, and the inner resin is formed by charging a constituent resin into a ring-shaped groove formed by a step between the basic region and the middle region, and includes a thick portion with a thickness larger than a thickness of an area covering the basic region wherein the thick portion includes an area where fluid resin used to form the resin mold portion merges.

2. The reactor according to claim 1, wherein the core piece includes both the middle region and the basic region that sandwiches the middle region.

3. The reactor according to claim 1, wherein the inner core includes a first core piece including the middle region, and two second core pieces including the basic region and sandwiching the first core piece.

4. The reactor according to claim 3, wherein gaps are provided between the first core piece and the second core pieces.

5. The reactor according claim 1, wherein the inner core includes at least one of a resin core piece that is a molded body made of a composite material containing magnetic powder and resin, and a green compact core piece that is a green compact molded body.

* * * * *